US006010265A

United States Patent [19]

Bouix

[11] Patent Number: 6,010,265

[45] Date of Patent: Jan. 4, 2000

[54] UNIDIRECTIONAL COSMETIC WIPER

[75] Inventor: Herve F. Bouix, New York, N.Y.

[73] Assignee: Color Access, Inc., Melville, N.Y.

[21] Appl. No.: 09/065,127

[22] Filed: Apr. 23, 1998

[51] Int. Cl.[7] ..... A46B 11/00

[52] U.S. Cl. ..... 401/122; 401/121

[58] Field of Search ..... 401/122, 121, 401/118, 119, 126, 127, 129

[56] References Cited

U.S. PATENT DOCUMENTS

| | | | |
|---|---|---|---|
| 3,861,810 | 1/1975 | Vasas | 401/122 |
| 4,433,928 | 2/1984 | Kingsford . | |
| 4,470,425 | 9/1984 | Gueret . | |
| 4,628,950 | 12/1986 | Bitzer . | |
| 4,671,689 | 6/1987 | Gueret . | |
| 4,810,122 | 3/1989 | Cole . | |
| 5,137,387 | 8/1992 | Byrd et al. | 401/122 |
| 5,349,972 | 9/1994 | Dirksing et al. | 401/122 |
| 5,875,791 | 3/1999 | Sheffler et al. . | |

FOREIGN PATENT DOCUMENTS

| | | | |
|---|---|---|---|
| WO 96/34546 | 4/1996 | WIPO | 401/122 |

*Primary Examiner*—David J. Walczak
*Attorney, Agent, or Firm*—Kenyon & Kenyon

[57] ABSTRACT

A wiper for use in a container for pasty products, such as mascara, lip gloss, eyeshadow, dental or oral care products, ointments, or the like, which wiper allows for the wiping of excess product from an applicator as the applicator is withdrawn from a container, but does not wipe the applicator as it is placed into the container. The wiper of the present invention comprises two or more flaps capable of occupying a first scraping position, when the applicator is withdrawn from the container, and a second non-scraping position, when the applicator is returned to the container.

The non-scraping position of the flaps allows the applicator to be placed into the container without being wiped. This characteristic reduces the build-up of product within the neck of the container, thus providing a cleaner, aesthetically pleasing package for the consumer to use.

9 Claims, 3 Drawing Sheets

UNIDIRECTIONAL COSMETIC WIPER

FIELD OF THE INVENTION

The present invention relates to wipers for cosmetic packages containing mascara or similar pasty products. More particularly, it relates to a wiper which allows for wiping excess product from an applicator only upon removal from the container, thus eliminating a build-up of product within the neck of the container as the applicator is inserted into the container after use.

BACKGROUND OF THE INVENTION

Cosmetics such as mascara are commonly sold in containers with an applicator projecting into the container and secured to the underside of the container cap. Radial projections such as bristles or teeth are provided on the applicator to hold cosmetic material thereon, and a wiper for the applicator is supported by the neck of the container. The wiper is typically a rubber, or similarly flexible plastic material, wherein the wiping end is pierced by an opening whose diameter is smaller than the minimum diameter of the brush measured at the tip of the bristles, so that the lip around the opening exerts a wiping action on the brush when the brush is withdrawn from the container. The problem associated with this type of wiper is that the brush is wiped as it is removed from the container as well as when it is placed into the container. The wiping of the brush as it is placed back into the container happens because the opening through which the brush passes is of a fixed diameter which will not flex sufficiently to let the brush enter the container without wiping. The wiping of the brush as it is introduced into the container leads to a continual build-up of product within the neck of the container, and eventually causes the neck of the container and the inside of the cap to become covered with product. Once this happens, it is inevitable that the consumer will not be able to use the package without soiling her hands with the product.

This invention provides for a cosmetic wiper which eliminates a build-up of product within the neck of a container by allowing a product applicator to be wiped of excess product as it is removed from a container and not wiped as the applicator is placed back into the container.

This invention also provides for a wiper which is simple for a consumer to use.

Also, this invention provides for a wiper which can be used with little or no modification to existing packaging.

Additionally, this invention provides for a wiper which does not interfere with package aesthetics.

SUMMARY OF THE INVENTION

The present invention provides a wiper for use in a container for pasty products, such as mascara, lip gloss, eyeshadow, dental or oral care products, ointments, or the like, which wiper allows for the wiping of excess product from an applicator as the applicator is withdrawn from the container, but does not wipe the applicator as it is placed into the container. The wiper of the present invention comprises two or more flaps capable of occupying a first scraping position, when the applicator is withdrawn from the container, and a second non-scraping position, when the applicator is returned to the container.

The non-scraping position of the flaps allows the applicator to be placed into the container without being wiped. This characteristic reduces the build-up of product within the neck of the container, thus providing a cleaner, aesthetically pleasing package for the consumer to use.

BRIEF DESCRIPTION OF THE DRAWINGS

Further objects and features of the present invention will be understood better in light of the embodiment examples which are discussed below with the aid of a drawing wherein.

DETAILED DESCRIPTION OF THE INVENTION

Figure 1A:
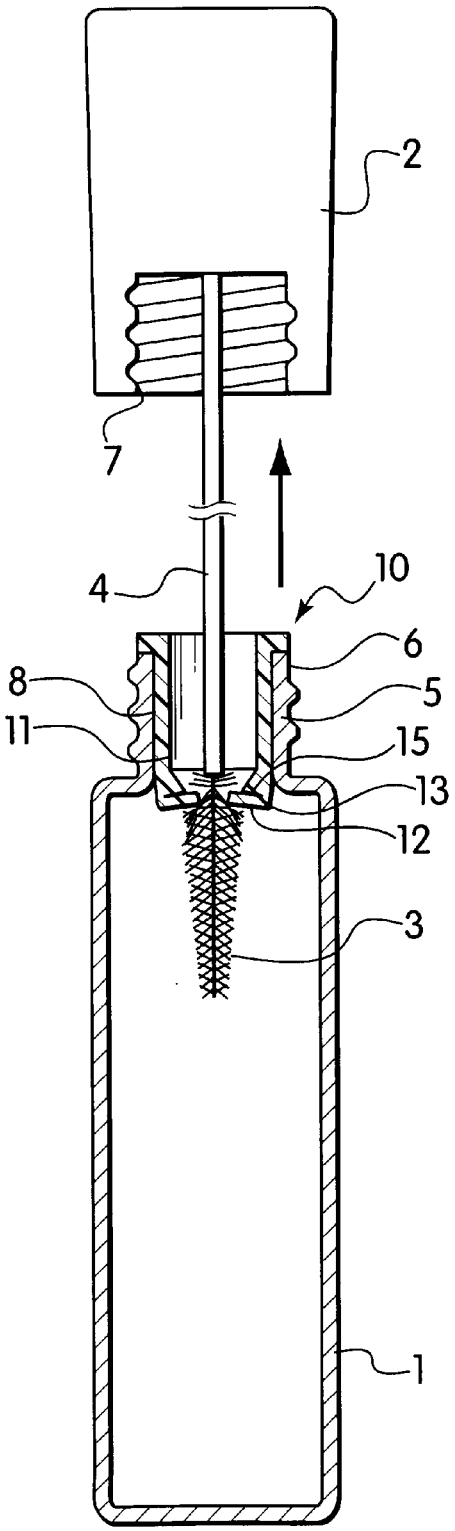
FIGS. 1A and 1B are sectional views of the wiper of the present invention as used within a cosmetic package.
Figure 1B:
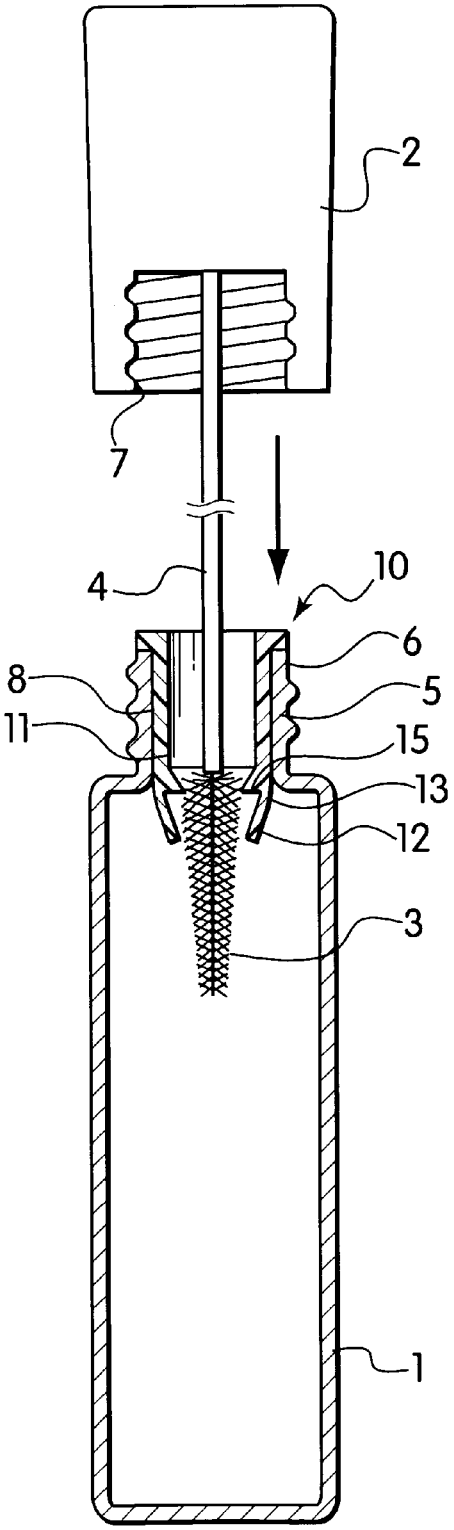

Referring now to the drawings, FIGS. 1A and 1B show one embodiment of the wiper of the present invention. For purposes of clarity, the present invention will be described as used in conjunction with a mascara package. This example is merely illustrative, and in no way limits the present invention to mascara. It will be apparent to one of ordinary skill in the art how the present disclosure can be adapted for use with any pasty product, including, but not limited to, lip gloss, eye shadow, lip balms, concealers, hair mascara, and the like.

A mascara package, as seen in FIGS. 1A and 1B, generally comprises a container 1, a cap 2 for closing the container, and an applicator 3, said applicator projecting into the container and attached to the underside of the cap 2 by a rod 4. The container 1 has a neck 5 which extends axially from one end of the container 1, said neck 5 providing access to the contents of the container 1. The external wall 6 of the neck 5 is provided with a means for attaching the cap to the container. Preferably, as shown in the drawings, the means for attaching the cap 2 to the neck 5 of the container 1 consists of a set of opposing threads placed on the outer wall 6 of the neck 5 and on the inner wall 7 of the cap 2. Other means of attaching a cap to a container neck are known and can also be used with the same result, for example, a snap closure, or a lug style closure.

Figure 2:
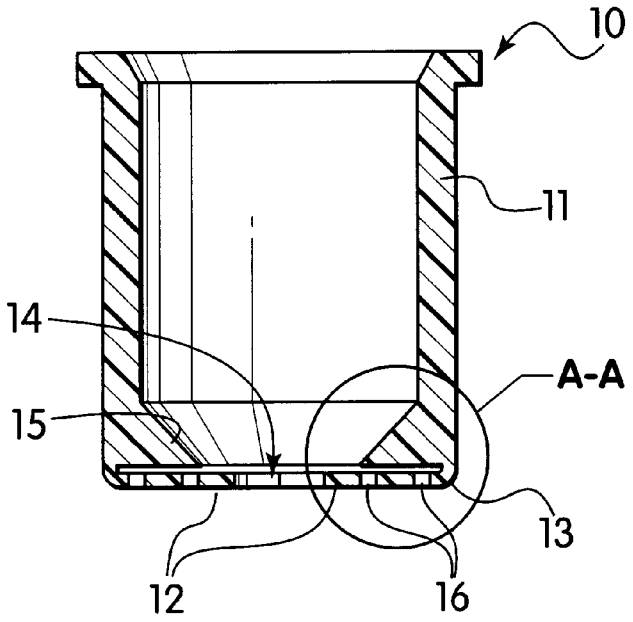
FIG. 2 is a sectional view of the wiper of the present invention.

In one embodiment, the wiper 10 of the present invention is placed along the inner wall 8 of the neck 5 (shown in greater detail in FIG. 2). The wiper 10 can be composed of natural or synthetic rubber materials, such as santoprene, neoprene, butyl rubber, nitrile rubber, silicone rubber, and the like; or flexible plastic materials, such as polyethylene, polypropylene, mixtures thereof, and the like; or similar elastomeric materials. The wiper 10 comprises a housing 11 having a longitudinal bore therethrough, one end of the housing, i.e., that which is proximal to the container opening, is an open end, and the opposite end, distal to the opening of the container, is the wiping end. Preferably, the housing 11 is cylindrical in shape.

Figure 4A:
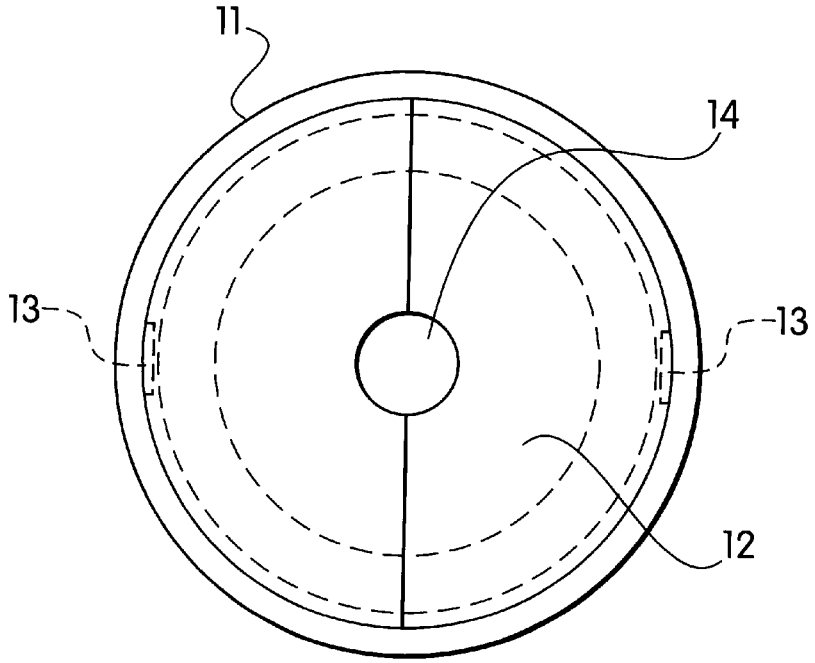
FIG. 4A is a plan view of the bottom of the wiper of the present invention showing two flaps.
Figure 4B:
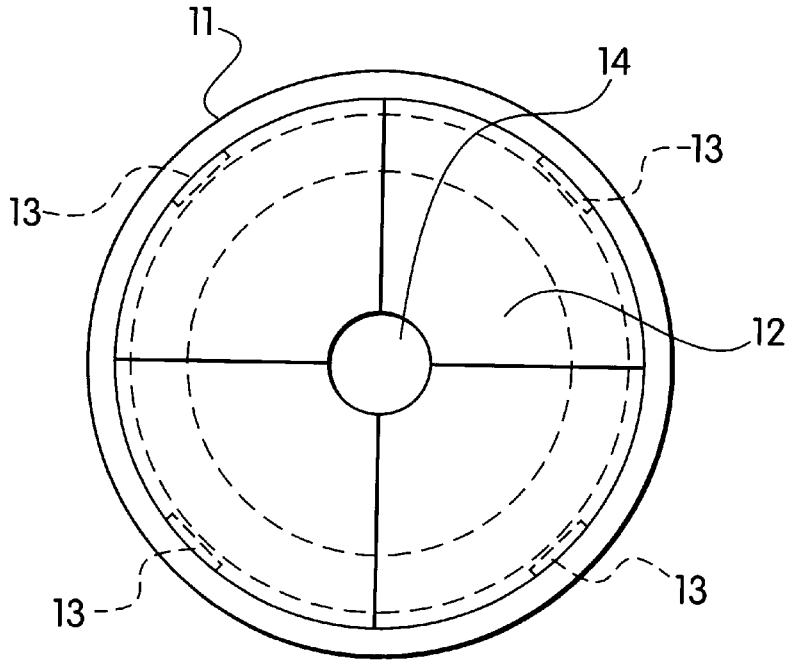
FIG. 4B is a plan view of the bottom of the wiper of the present invention showing four flaps.

Two or more flaps 12 are connected to the wiping end of the housing. As seen in FIGS. 4A and 4B, regardless of the number of flaps 12, each flap 12 is connected to the housing 11 by a living-hinge 13. The hinge 13 allows the flaps 12 to occupy a first scraping position and a second non-scraping position (as seen in FIGS. 1A and 1B). The hinge 13 can be formed of the same flexible material as the housing 11 and the flaps 12 using conventional injection molding techniques. Preferably, however, the hinge 13 is formed from a different material from that of the housing 11 and flaps 12 through bi-injection molding techniques. That is, during the molding of the housing 11 and the flaps 12, a different material for each the housing and the flaps, such as polyethylene for the housing and nitrile rubber for the flaps, is injected simultaneously into the mold, and as the materials cool they are fused together. The dimensions of the hinge 13 will be dependent on the material used, and on the desired amount of flexibility required of the hinge. For example, if the brush used has relatively soft bristles, then the hinge needs to be flexible enough to allow the flaps to pivot without exerting a wiping action on the bristles of the brush. If the brush has relatively stiff bristles, then the hinge need not be as flexible because the stiffness of the bristles will assist in pivoting the flaps.

The flaps 12 are dimensioned in a manner which will allow the rod 4 and applicator 3 to pass, while at the same time removing excess product from the rod 4 and applicator 3. To accomplish this, the flaps 12 meet to form an orifice 14 when they are in the scraping position, as seen in FIGS. 1A, 2, 4A and 4B. Preferably, the orifice 14 is circular in shape. However, the shape of the orifice 14 can be varied so that the excess product can be scraped in a pattern. For example, if the orifice 14 is star-shaped, the excess product will be scraped more in the sections of the star-shape that project inwardly, and less in the outwardly projecting sections. In order for the flaps to be able to exert a wiping action on the applicator as it is withdrawn from the container, the diameter of the orifice is smaller than the minimum diameter of the brush measured at the tip of the bristles. Preferably, the orifice 14 is of a diameter sufficient to engage the rod 4 as it is withdrawn from the container 1, but not so small as to prevent the rod 4 from being removed.

Figure 3:
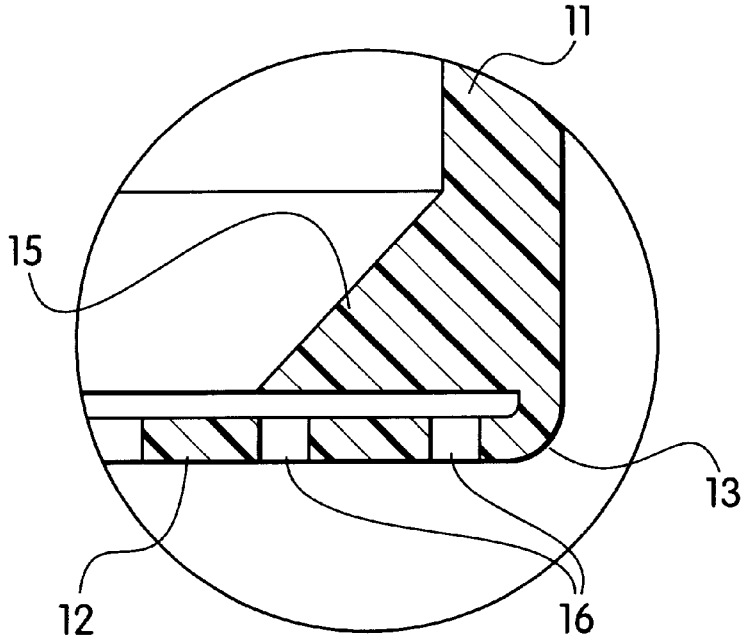
FIG. 3 is a cross-sectional view taken along section A—A of FIG. 2.

As seen in FIGS. 1A and 1B, operation of the wiper 10 is simple. As the applicator 3 is withdrawn from the container 1, the rod 4 and applicator 3 engage the flaps 12 of the wiper 10. The flaps 12, in turn, are engaged by a stop 15 which retains the flaps 12 in a wiping position. The stop 15 can be the wiping end of the housing, or preferably, the stop 15 is formed as an inwardly projecting wedge as seen in FIG. 3. The use of the inwardly projecting wedge allows for a wider surface with which to retain the flaps in the wiping position.

When the applicator 3 is returned to the container 1, the applicator 3 contacts the flaps 12 and the flaps 12 pivot about the hinge 13 into a non-scraping position, as seen in FIG. 1B. Thus, the consumer returns the applicator 3 to the container 1 in the same manner as a conventional mascara package. A conventional mascara package, however, typically has a wiper with a fixed diameter wiping opening which is not capable of flexing sufficiently to allow the brush to be placed back into the container without wiping. In contrast, the wiper 10 of the present invention does not have a fixed diameter wiping opening. The present wiper has hinged flaps 12 which form an opening 14 that allows the applicator 3 to be scraped as it is removed from the container 1, and the same flaps 12 pivot about the hinge 13 and open to a size which will not allow the applicator 3 to be scraped as it is returned to the container 1.

In an alternate embodiment, as seen in FIGS. 2 and 3, the flaps 12 are provided with one or more holes 16. As the consumer repeatedly inserts the applicator into the container after application of the product, the incidental contact between the applicator and the flaps in the non-scraping position may cause some residual amount of product to rub-off onto the topside of the flaps. Over time, this residual amount of product could build and possibly interfere with the operation of the flaps. The holes 16 allow the product to pass back into the container, thus enabling the product to be picked up by the applicator and used by the consumer.

In a further embodiment, the flaps of the wiper are attached directly to the inside wall of the container. To form the container and flaps in this manner, the flaps are bi-injection molded directly with the container. The flaps are placed within the container between the opening of the container and the storage compartment for the product. Preferably, the flaps are located near the opening of the container so that a larger storage compartment can be provided for the product. When the flaps are attached to the inner wall of the container they operate in the same manner as when they are an integral part of a separate wiper inserted into the neck of the container, as previously described. When the applicator is removed from the container, the flaps scrape the excess product; when the applicator is returned to the container, the flaps pivot about a hinge into a non-scraping position and allow the applicator to pass.

The advantage to this wiper is that its use will reduce the build-up of product within the neck of the container, thus providing for a cleaner, aesthetically pleasing package for the consumer to use.

The invention, and its broader aspects, is not limited to the specific details shown and described; rather, various modifications will be suggested to one skilled in the art, all of which are within the scope of this invention.

What is claimed is:

1. A package for a pasty product, said package comprising :

a hollow container having a neck, said neck providing access to the container;

an applicator, said applicator projecting through the neck and into the container; and a wiper placed within the neck of the container, said wiper comprising:

a hollow housing having a wiping end and an open end;

two or more flaps, said flaps pivoted by the applicator between a first scraping position as the applicator is withdrawn from the container, and a second non-scraping position as the applicator is returned to the container; and two or more hinges, each hinge connecting one of the two or more flaps to the wiping end of the housing.

2. The wiper of claim 1 wherein the housing and the flaps are composed of different flexible materials.

3. The wiper of claim 1 wherein the wiper is composed of a natural or synthetic rubber.

4. The wiper of claim 3 wherein the wiper is composed of santoprene, neoprene, butyl rubber, nitrile rubber, or silicone rubber.

5. The wiper of claim 1 wherein the wiper is composed of a flexible plastic material.

6. The wiper of claim 5 wherein the wiper is composed of polyethylene, polypropylene, or mixtures thereof.

7. The package of claim 1 wherein the flaps are shaped so as to meet and form an orifice capable of scrapping excess product from an applicator.

8. The package of claim 1 wherein the wiping end of the housing is provided with a stop, said stop engaging the flaps and retaining the flaps in the scraping position as the applicator is withdrawn from the container.

9. The package of claim 1 wherein each flap has one or more holes therethrough.

* * * * *